US007411476B2

(12) United States Patent
Stanke et al.

(10) Patent No.: US 7,411,476 B2
(45) Date of Patent: Aug. 12, 2008

(54) COMBINATION OF A SWITCHING DEVICE AND A PRINTED BOARD

(75) Inventors: Stephan Stanke, Rheinbach (DE); Ulrich Trapp, Grafschaft (DE)

(73) Assignee: Moeller GmbH, Bonn (DE)

( * ) Notice: Subject to any disclaimer, the term of this patent is extended or adjusted under 35 U.S.C. 154(b) by 543 days.

(21) Appl. No.: 10/545,462

(22) PCT Filed: Aug. 4, 2004

(86) PCT No.: PCT/EP2004/051710

§ 371 (c)(1),
(2), (4) Date: Aug. 12, 2005

(87) PCT Pub. No.: WO2005/017934

PCT Pub. Date: Feb. 24, 2005

(65) Prior Publication Data

US 2006/0152312 A1 Jul. 13, 2006

(30) Foreign Application Priority Data

Aug. 15, 2003 (DE) ..... 103 38 122

(51) Int. Cl.
*H01H 13/04* (2006.01)

(52) U.S. Cl. ..... 335/202

(58) Field of Classification Search ..... 335/202, 335/278

See application file for complete search history.

(56) References Cited

U.S. PATENT DOCUMENTS 4,368,394 A 1/1983 Naimer ..... 307/115
4,715,822 A 12/1987 Stribel ..... 439/74
5,823,798 A 10/1998 Zintler et al. ..... 439/76.2
6,520,780 B2 2/2003 Chemin ..... 439/76.2

FOREIGN PATENT DOCUMENTS

| | | |
|---|---|---|
| DE | 34 23 854 | 1/1986 |
| DE | 35 25 085 | 1/1987 |
| DE | 41 15 092 | 11/1992 |
| DE | 43 32 068 | 3/1994 |
| DE | 195 44 235 | 2/1997 |
| DE | 196 46 004 | 5/1998 |
| DE | 199 02 745 | 8/2000 |
| DE | 101 16 797 | 10/2001 |

(Continued)

OTHER PUBLICATIONS

International Search Report for PCT/EP2004/051710 (4 pages).

(Continued)

*Primary Examiner*—Ramon M Barrera
(74) *Attorney, Agent, or Firm*—Darby & Darby

(57) ABSTRACT

A combination of an electromagnetic switching device and a printed circuit board incoming and outgoing connecting conductors associated with switchable conducting paths in the switching device. The connecting conductors are each associated with a connecting terminal for connecting an external electrical conductor. Pin contacts are connected to the printed circuit board for establishing a connection to the switching device. Each of the connecting conductors includes a contact receptacle accessible from the front of the switchgear housing for providing a contact connection to one of the pin contacts.

7 Claims, 3 Drawing Sheets

FOREIGN PATENT DOCUMENTS

| | | |
|---|---|---|
| DE | 101 34 419 | 2/2003 |
| DE | 102 36 790 | 10/2003 |
| EP | 0 779 640 | 6/1997 |
| EP | 0 936 847 | 8/1999 |
| WO | WO 81/01092 | 4/1981 |

OTHER PUBLICATIONS

German Search Report for DE 103 38 122.8 (4 pages) with brief translation thereof (3 pages).

COMBINATION OF A SWITCHING DEVICE AND A PRINTED BOARD

The present invention relates to a combination of at least one electromagnetic switching device and a printed circuit board, incoming and outgoing connecting conductors being associated with switchable conducting paths inside the switching device, and pin contacts connected to the printed circuit board establishing the connection to the switching device.

BACKGROUND

German Patent Publication DE 41 15 092 A1 describes the mounting of electromagnetic switching devices on printed circuit boards. To this end, the switching device is provided on the back with soldering pins which are inserted into corresponding holes and then soldered to contacting conductor surfaces of the printed circuit board. The disadvantage is that in the event of a failure of the switching device, the failed device can be replaced with a new one only with great effort and with the risk of damaging the printed circuit board or the switching device. Another disadvantage is that, for conventional wiring on the one hand, and, on the other hand, for connection to printed circuit boards, switching devices that are suitable for the respective connection method have to be provided separately.

European Patent Publication EP 0 779 640 A2 discloses a combination of an electromagnetic switching device and a bus-compatible amplifier module. The switching device is provided with connecting terminals and coil terminals on the connection sides running perpendicular to the front of the switching device. The connecting terminals are connected inside the device to switchable conducting paths, i.e., to power and auxiliary contacts, via connecting conductors. The amplifier module has connector pins which are connectable to the coil terminals leading to the operating coil of the switching device. This combination does not provide for the connection of the amplifier module to the switchable conducting paths via the pin contacts. World Patent Publication WO 81/01092 A1 describes a switching device having an integrated printed circuit board which is connected via pin contacts to a further printed circuit board inside the switching devices.

SUMMARY OF THE INVENTION

It is therefore an object of the present invention to enable damage-free replacement of an electromagnetic switching device connected to a printed circuit board without requiring a complex design.

The present invention provides a combination of at least one electromagnetic switching device and a printed circuit board. The combination includes: a plurality of incoming and outgoing connecting conductors associated with respective switchable conducting paths in the at least one switching device, the connecting conductors being each associated with a respective connecting terminal configured to connect a respective external electrical conductor laterally relative to a front of a switchgear housing of the switching device; and a plurality of pin contacts connected to the printed circuit board and configured to establish a connection to the at least one switching device. Each of the connecting conductors includes a respective contact receptacle accessible from the front of the switchgear housing and configured to frictionally and/or in a form-locking manner provide a contact connection to a respective one of the pin contacts with the printed circuit board disposed opposite the front of the switchgear housing.

By equipping the switching device with connecting conductors for connection of both wire- or bar-type external conductors and of pin contacts connected to a printed circuit board, the switching device, which is thus also suitable for conventional wiring, forms the inventive combination including the printed circuit board. The connection to the printed circuit board can be established and released, if required, by the frictional and/or form-locking connection between the contact receptacles and the pin contacts. Thus, it is possible, on the one hand, to implement combinations of switching devices and printed circuit boards including switching devices that are intended for conventional wiring and, on the other hand, to provide for easy replacement of the switching devices. The formation of a conventionally designed connecting terminal (such as a screw terminal or a spring terminal) and of the contact receptacle is accomplished in a structurally and technically simple way by means of the connecting conductors. Inside the housing, the connecting conductor merges into a fixed switching contact in a usual manner.

To reliably establish the contacting connection to the pin contacts, it is advantageous for the contact receptacles to be located closer to the center of the switching device as compared to the connecting terminals. In a preferred embodiment, the contact receptacles are designed as inner openings of the connecting conductors. Other designs of the contact receptacles, such as lateral recesses in the connecting conductors are also possible. To optimize the contacting with the pin contacts, the openings are made as punched rim holes, so that the openings have tab-like extensions projecting from the edges thereof, at least in some regions. For stable contacting, it is also advantageous for the connecting conductors to be widened in the region of the contact receptacles.

To minimize the wiring effort, the printed circuit board is advantageously provided with incoming and outgoing power connections. Advantageously, the printed circuit board is equipped with electrical and/or electronic components, so that complex control and/or communication tasks can be implemented using the combination of the present invention.

By using a printed circuit board combined with a single electromagnetic switching device, a connection to a circuit-breaker can be established with minimized wiring effort, in particular for forming a fuseless direct-on-line motor starter. A printed circuit board combined with two electromagnetic switching devices can be used with minimized wiring effort to form contactor combinations or, in conjunction with a circuit-breaker, to form complex motor starter combinations, such as to form star-delta combinations, or reversing contactors, and star-delta starters or reversing starters, respectively.

BRIEF DESCRIPTION OF THE DRAWINGS

Further details and advantages of the present invention will become apparent from the exemplary embodiment described below with reference to the Figures, in which.

DETAILED DESCRIPTION

Figure 1:
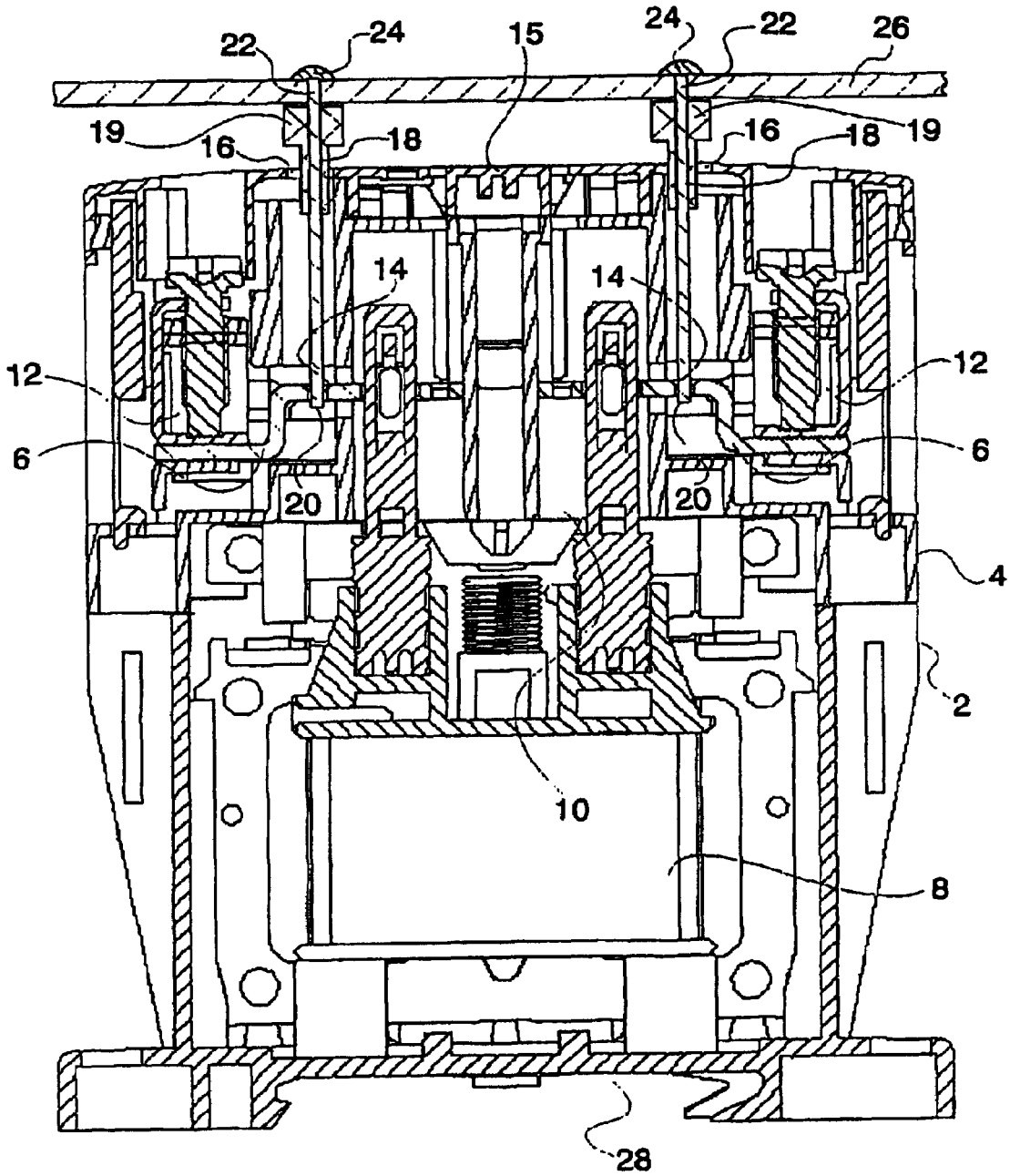
FIG. 1 is a longitudinal cross-section of a combination according to the present invention.

FIG. 1 shows a three-pole electromagnetic switching device 2 having a surrounding insulating switchgear housing 4, and incoming and outgoing connecting conductors 6. Connecting conductors 6 are fixed in switchgear housing 4 in a usual manner and are provided with stationary contacts on their ends inside switching device 2, said stationary contacts cooperating polewise with a contact bridge, said contact bridges being supported in a common contact bridge carrier 10 operated by an electromagnetic operating mechanism 8. Switchgear housing 4 accommodates connecting terminals 12 on both sides, said connecting terminals being externally accessible from the sides for connection of external conductors. Each of the connecting terminals 12 is part of one of the connecting conductors 6. Connecting conductors 6 are each provided with a contact receptacle 14 between the inner ends and connecting terminals 12. Switchgear housing 4 is provided at switchgear front 15 with openings 16 extending to connecting conductors 6. Pin contacts 18 extend through openings 16, said pin contacts extending with their contact ends 20 into contact receptacles 14, thereby being conductively connected to the connecting conductors 6. The connection between connecting conductors 6 and pin contacts 18 can be released by pulling the pin contacts out. In their upper portion, pin contacts 18 are covered with an insulating plastic sheath 19 and, at their attachment ends 22 opposite the contact ends 20, are mechanically and electrically connected to a printed circuit board 26 by solder connections 24. Thus, switching device 2 is mechanically and electrically connected to printed circuit board 26 in a releasable manner. Therefore, electrically and mechanically, switching device 2 and printed circuit board 26 form a combination 1 which can be snapped onto a standard mounting rail by a snap-on mechanism 28 provided on the back of switching device 2. Pin contacts 18 can also be secured to printed circuit board 26 by plug-in connections.

Figure 2C:
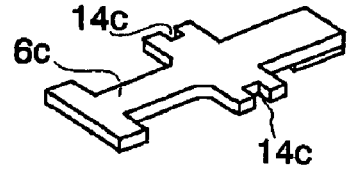
FIG. 2 shows different embodiments of the connecting conductor in a perspective view.
Figure 2B:
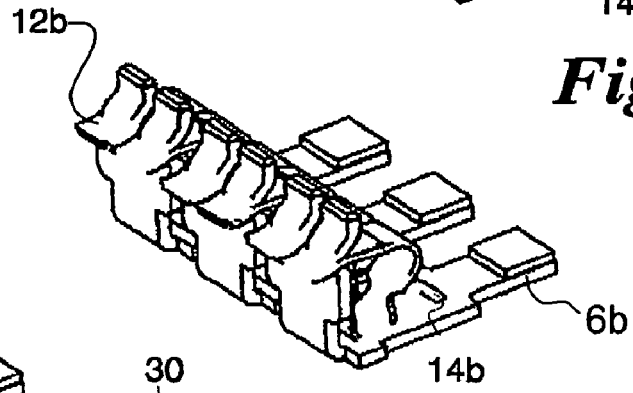

FIG. 2 shows three variants 6*a*, 6*b* and 6*c* of the connecting conductor. In Subfigure 2*a*, connecting conductors 6*a* are provided at their outer ends with connecting terminals in the form of screw terminals 12*a*. The inner ends of connecting conductors 6*a* are provided with fixed contact facings 30 and 32 for three main contacts and one auxiliary contact, respectively. Connecting conductors 6*a* are widened about in the middle of their length and provided there with contact receptacles 14*a* in the form of central rectangular openings. In Subfigure 2*b*, connecting conductors 6*b* are provided at their outer ends with connecting terminals in the form of spring terminals 12*b*. In their portion facing outward, connecting conductors 6*b* are widened compared to the inner third and, in turn, are provided with contact receptacles 14*b* in the form of central rectangular openings the central portion. In contrast, the variant of a connecting conductor 6*c* shown in Subfigure 2*c* has a contact receptacle 14*c* which is provided on the widened central portion in the form of opposite lateral recesses.

Figure 2A:
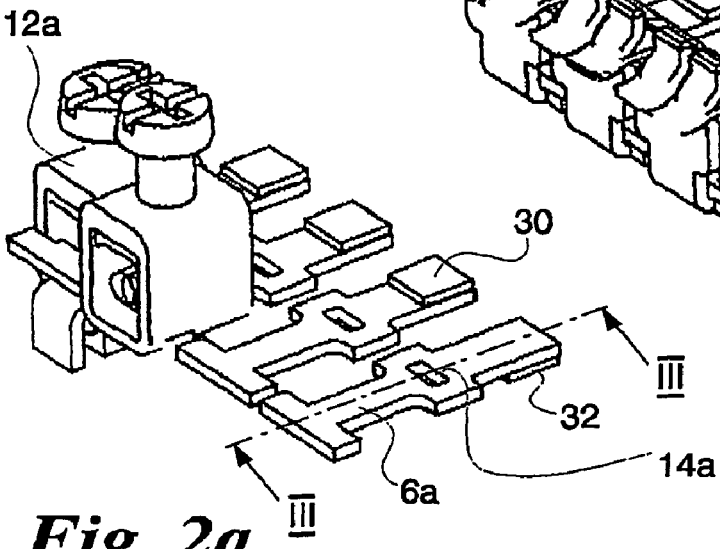
Figure 3:
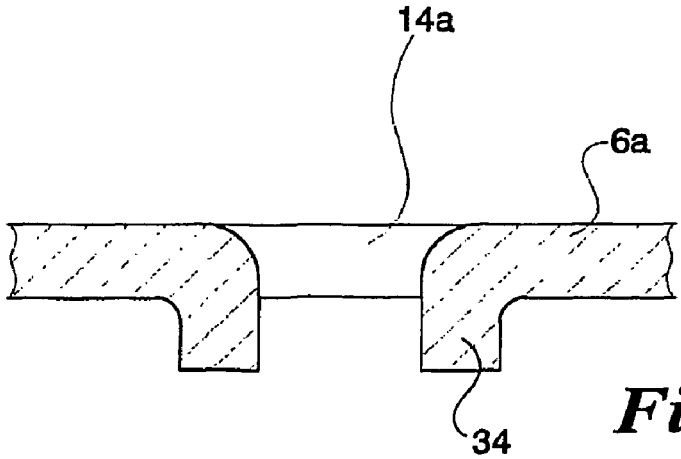
FIG. 3 shows a detail in a cross-section III-III from FIG. 2*a;*

FIG. 3 is a cross-sectional detail view of the central portion of connecting conductor 6*a* of FIG. 2*a*. To improve the contacting between pin contact 18 (FIG. 1) and connecting conductor 6*a*, contact receptacle 14*a* is provided with contact tab sections 34 which are bent toward the back of the switching device. Contact tab sections 34 are made during the manufacture of contact receptacle 14*a* as a punched rim hole. Contact receptacles 14*b* and 14*c* of Subfigures 2*b* and 2*c*, respectively, can be provided with contact tab sections in the same or analogous way.

Figure 4:
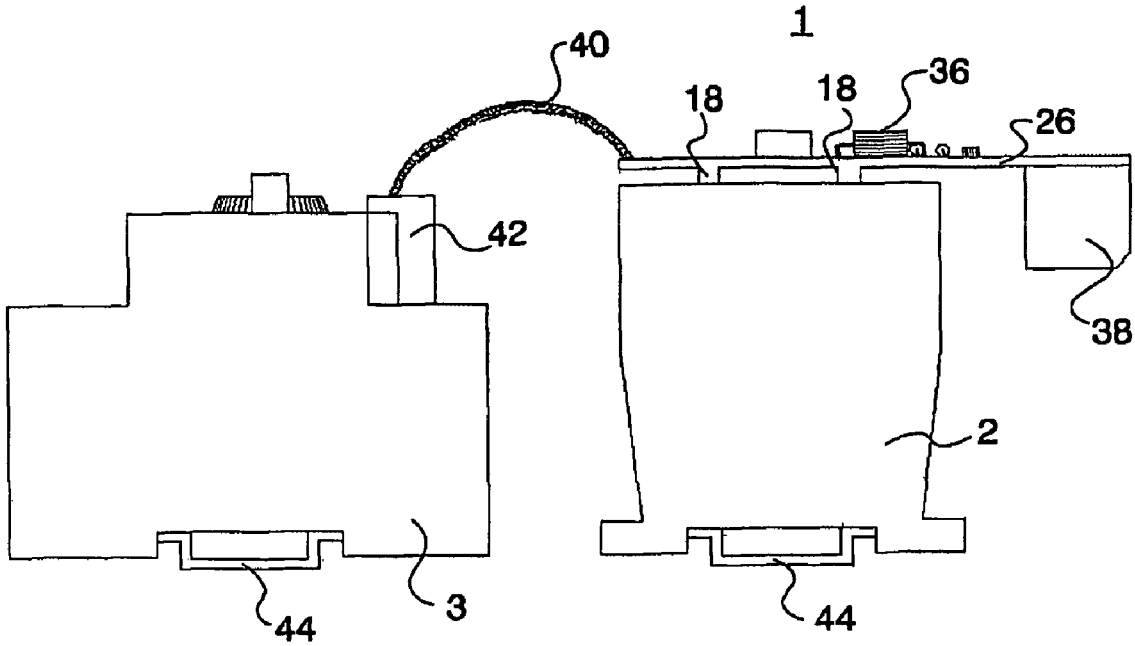
FIG. 4 shows a first exemplary combination according to the present invention, including one electromagnetic switching device.

In FIG. 4, the combination 1 of electromagnetic switching device 2 and printed circuit board 26 illustrated in FIG. 1 is shown together with a further switching device in the form of a circuit-breaker 3. Printed circuit board 26 has mounted thereon electrical and electronic components 36. On one side, power connections in the form of clamp-type terminals 38 are mounted on printed circuit board 26 for connection to a main current transmission line. On the other side, outgoing power connections in the form connecting conductors 40 are soldered to printed circuit board 26 and connected via a plug connector 42 to main- and auxiliary current inputs of circuit-breaker 3. The contacting between plug connector 42 and the connecting conductors of the circuit-breaker is accomplished similarly as described in FIG. 1 for the contacting between pin contacts 18 of printed circuit board 26 and connecting conductors 6 of electromagnetic switching device 2. Both the combination 1 and circuit-breaker 3 are mounted on standard mounting rails 44 by snap-on mechanisms provided on the back of switching devices 2 and 3. The arrangement shown in FIG. 4 constitutes a compact, prewired direct-on-line motor starter.

Figure 5:
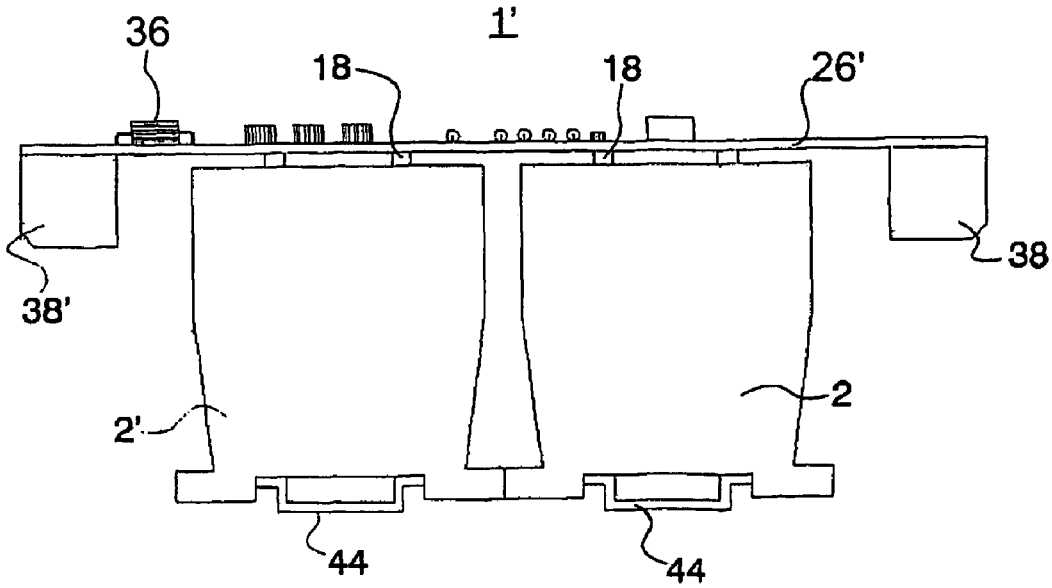
FIG. 5 shows a second exemplary combination including two electromagnetic switching devices.

FIG. 5 shows a combination 1', including two electromagnetic switching devices 2 and 2' which are connect to printed circuit board 26'. Here too, printed circuit board 26' is equipped with electrical and electronic components 36. Combination 1' can be used as a star-delta combination or as a reversing contactor if printed circuit board 26' is wired accordingly. Printed circuit board 26' is provided at both ends with incoming and outgoing clamp-type termninals 38 and 38', respectively. Thus, combination 1' constitutes a compact, prewired unit, which is mechanically attached to standard mounting rails 44 by the snap-on mechanisms provided on the back of switching devices 2 and 2'.

What is claimed is:

1. A combination of at least one electromagnetic switching device and a printed circuit board, comprising:

a plurality of incoming and outgoing connecting conductors associated with respective switchable conducting paths in the at least one switching device, the connecting conductors being each associated with a respective connecting terminal configured to connect a respective external electrical conductor laterally relative to a front of a switchgear housing of the switching device; and a plurality of pin contacts connected to the printed circuit board and configured to establish a connection to the at least one switching device;

wherein each of the connecting conductors includes a respective contact receptacle accessible from the front of the switchgear housing and configured to frictionally and/or in a form-locking manner provide a contact connection to a respective one of the pin contacts with the printed circuit board disposed opposite the front of the switchgear housing.

2. The combination as recited in claim 1 wherein each contact receptacle is disposed between the respective connecting terminal and an interior of the switching device.

3. The combination as recited in claim 1 wherein each contact receptacle includes an inner opening or a lateral recess of the respective connecting conductor.

4. The combination as recited in claim 1 wherein each contact receptacle includes, at an edge thereof, a contact tab section projecting toward the front or a back of the switchgear housing.

5. The combination as recited in claim 1 wherein each connecting conductor includes a widened portion in a region of the respective contact receptacle.

6. The combination as recited in claim 1 wherein the printed circuit board includes incoming and outgoing power connections.

7. The combination as recited in claim 1 wherein the printed circuit board includes at least one electrical and/or electronic component.

* * * * *